US011319608B2

(12) United States Patent
Li et al.

(10) Patent No.: US 11,319,608 B2
(45) Date of Patent: May 3, 2022

(54) HIGH-STRENGTH AND CORROSION-RESISTANT SUCKER ROD AND PREPARATION PROCESS THEREOF

(71) Applicant: ZHEJIANG RUIZHI STEEL CO., LTD., Wenzhou (CN)

(72) Inventors: Yongan Li, Wenzhou (CN); Naijia Yang, Wenzhou (CN)

(73) Assignee: ZHEJIANG RUIZHI STEEL CO., LTD., Wenzhou (CN)

( * ) Notice: Subject to any disclaimer, the term of this patent is extended or adjusted under 35 U.S.C. 154(b) by 0 days.

(21) Appl. No.: 17/267,043

(22) PCT Filed: Nov. 21, 2019

(86) PCT No.: PCT/CN2019/119892

§ 371 (c)(1),
(2) Date: Feb. 9, 2021

(87) PCT Pub. No.: WO2020/103895

PCT Pub. Date: May 28, 2020

(65) Prior Publication Data

US 2021/0262053 A1 Aug. 26, 2021

(30) Foreign Application Priority Data

Nov. 22, 2018 (CN) ..... 201811400584.6

(51) Int. Cl.

| | |
|---|---|
| ***C21D 9/00*** | (2006.01) |
| ***C21D 1/60*** | (2006.01) |
| ***C21D 6/00*** | (2006.01) |
| ***C21D 8/06*** | (2006.01) |
| ***C22C 38/00*** | (2006.01) |

(Continued)

(52) U.S. Cl.

CPC ..... *C21D 9/0075* (2013.01); *C21D 1/60* (2013.01); *C21D 6/004* (2013.01); *C21D 6/005* (2013.01);

(Continued)

(58) Field of Classification Search

None

See application file for complete search history.

(56) References Cited

U.S. PATENT DOCUMENTS

| | | | | |
|---|---|---|---|---|
| 2019/0169706 | A1* | 6/2019 | Liu | C21D 6/008 |
| 2019/0211630 | A1* | 7/2019 | Martinez | C21D 9/14 |
| 2019/0211633 | A1* | 7/2019 | Badrak | C21D 1/18 |

FOREIGN PATENT DOCUMENTS

| | | | |
|---|---|---|---|
| CN | 104313479 | A | 1/2015 |
| CN | 105441816 | A | 3/2016 |

(Continued)

OTHER PUBLICATIONS

Espacenet machine translation of ON 108406235 (Year: 2021).*

(Continued)

*Primary Examiner* — Brian D Walck
*Assistant Examiner* — Christopher D. Moody
(74) *Attorney, Agent, or Firm* — Bayramoglu Law Offices LLC

(57) ABSTRACT

A high-strength and corrosion-resistant sucker rod and a preparation process thereof are disclosed. Raw materials for preparing the high-strength and corrosion-resistant sucker rod include, by weight percent, Mn: 0.70% to 1.20%, Cr: 9.50% to 13.50%, Ni: 0.65% to 1.10%, Mo: 0.10% to 0.90%, Cu: 0.28% to 0.56%, C: ≤0.07%, Si: ≤0.50%, P: ≤0.08%, and S: ≤0.005%, the balance is Fe and unavoidable impurities. The sucker rod prepared by the new process has an actual grain size equal to or greater than grade 8, excellent mechanical properties that meet the standard of grade HL specified in SY/T5029 *Sucker Rods*, and excellent corrosion fatigue resistance. The preparation process is simple and easy for operation, and suitable for large-scale promotion.

6 Claims, 4 Drawing Sheets

Before the Test

After the Test

(51) Int. Cl.

| | |
|---|---|
| ***C22C 38/02*** | (2006.01) |
| ***C22C 38/04*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***F04B 47/02*** | (2006.01) |

(52) U.S. Cl.
CPC ..... *C21D 6/008* (2013.01); *C21D 8/065* (2013.01); *C22C 38/002* (2013.01); *C22C 38/02* (2013.01); *C22C 38/04* (2013.01); *C22C 38/42* (2013.01); *C22C 38/44* (2013.01); *C22C 38/46* (2013.01); *C22C 38/48* (2013.01); *F04B 47/026* (2013.01)

(56) References Cited

FOREIGN PATENT DOCUMENTS

| | | | | |
|---|---|---|---|---|
| CN | 106399867 | A | | 2/2017 |
| CN | 107099756 | A | | 8/2017 |
| CN | 108106235 | A | * | 6/2018 |
| CN | 109487175 | A | | 3/2019 |
| JP | S60238418 | A | | 11/1985 |

OTHER PUBLICATIONS

SY/T5029, Sucker Rods, Petroleum and Natural Gas Industry Standard of the People's Republic of China, 2013, Petroleum Industry Press.

NACETM0284-2016, Evaluation of Pipelines and Pressure Vessel Steels for Resistance to Hydrogen-Induced Cracking, NACE International, 2016, pp. 1-28.

SY/T5273-2014, Technical Specifications and Evaluating Methods of Corrosion-inhibitors for Oilfield Produced Water, Petroleum and Natural Gas Industry Standard of the People's Republic of China, 2014, Petroleum Industry Press.

SY/T5329-2012, Water quality standard and practice for analysis of oilfield injecting waters in clastic reservoirs, Petroleum and Natural Gas Industry Standard of the People's Republic of China, 2012, Petroleum Industry Press.

NACERP-0775-91, Preparation and Installation of Corrosion Coupons and Interpretation of Test Data in Oilfield Operations, NACE Standard, pp. 1-12, 53031.

GB/T 228.1.2010, Metallic materials—Tensile testing—Part I :Method of test at room temperature, National Standards of People's Republic of China, 2010, pp. 1-61, Standards Press of China.

GB/T 6394-2002, Metal-methods for estimating the average grain size, National Standards of People's Republic of China, 2002, pp. 1-21, Standards Press of China.

GB/T 13320-2007, Metellographic grading atlas and assessing method for steel die forgings, National Standards of People's Republic of China, 2007, pp. 1-18, Standards Press of China.

GB/T 230.1-2009, Metallic materials—Rockwell hardness test-Part 1:Test method (scales A、B、C、D、E、F、G、H、K、N、T), National Standards of People's Republic of China, 2009, pp. 1-18, Standards Press of China.

* cited by examiner

Before the Test

After the Test

Before the Test

HIGH-STRENGTH AND CORROSION-RESISTANT SUCKER ROD AND PREPARATION PROCESS THEREOF

CROSS REFERENCE TO RELATED APPLICATIONS

This application is the national phase entry of International Application No. PCT/CN2019/119892, filed on Nov. 21, 2019, which is based upon and claims priority to Chinese Patent Application No. 201811400584.6, filed on Nov. 22, 2018, the entire contents of which are incorporated herein by reference.

TECHNICAL FIELD

The present invention relates to the technical field of steel materials, and particularly to a high-strength and corrosion-resistant sucker rod and a preparation process thereof.

BACKGROUND

A sucker rod is an important part of pumping equipment. During the pumping process, the sucker rod bears various loads and friction caused by the relative movement of the rod. Moreover, the sucker rod comes in direct contact with a variety of corrosive media (such as salt ions, chloride ions, carbon dioxide, hydrogen sulfide, and others) and abrasive sand in the oil well. In addition, with the increasingly complex oil exploitation environment, the content of corrosive substances such as chloride ions and hydrogen sulfide in a large number of oil fields increases year by year, and the probability of sucker rod fracture will increase when the rods are exposed to corrosive environments for extended periods, which will cause great economic losses to the oil-field exploitation industry. Therefore, a sucker rod with improved bearing capacity and corrosion resistance is highly desirable.

Chinese patent CN107099756A discloses steel for high-strength and corrosion-resistant sucker rods. The chemical composition of the steel is as follows: Si: 0.15% to 0.25%, Mn: 1.8% to 2.5%, Ni: 2.0% to 2.4%, Cr: 11% to 11.5%, Mo: 0.40% to 0.60%, Cu: 0.20% to 0.35%, Ti: 0.10% to 5 (C %−0.02)%, C: ≤0.055%, Al: 0.010% to 0.025%, P: ≤0.025%, S: ≤0.010%, [N]: 0.015% to 0.025%, the balance is Fe and unavoidable impurities. The preparation method of the steel includes: smelting, ingot casting, ingot annealing, billet forging, bar rolling, and steel annealing. However, the content of precious metals such as Ni and Mo in this patent is relatively high, which increases the cost, and the mechanical properties of the prepared steel for the high-strength and corrosion-resistant sucker rods are poor.

Chinese patent CN104313479A discloses a corrosion-resistant sucker rod and a manufacturing method thereof. The material composition of the rod body is as follows: C: 0.15% to 0.25%, Cr: 0.5% to 1.0%, Mo: 0.1% to 0.2%, Si: 1.0% to 1.5%, Mn: 1.5% to 2.5%, Cu: 0.05% to 0.2%, Ti: 0.05% to 0.15%, Nb: 0.2% to 0.4%, rare earth 0.1% to 0.15%, and the balance is Fe. In this patent, the strength and corrosion resistance of the sucker rod are enhanced by increasing the content of Si, and the corrosion resistance and fatigue resistance of the sucker rod are further improved by introducing rare-earth elements and a reasonable alloy ratio. However, the corrosion resistance of the sucker rod prepared by this patent is poor.

SUMMARY

In view of the above deficiencies, the present invention provides a high-strength and corrosion-resistant sucker rod and a preparation process thereof.

The technical solution adopted by the present invention to solve the above-mentioned deficiencies is as follows: a high-strength and corrosion-resistant sucker rod, raw materials for preparing the high-strength and corrosion-resistant sucker rod include: by weight percent, manganese (Mn): 0.70% to 1.20%, chromium (Cr): 9.50% to 13.50%, nickel (Ni): 0.65% to 1.10%, molybdenum (Mo): 0.10% to 0.90%, cuprum (Cu): 0.28% to 0.56%, carbon (C): ≤0.07%, silicon (Si): ≤0.50%, phosphorus (P): ≤0.08%, sulfur (S): ≤0.005%, and the balance is ferrum (Fe) and unavoidable impurities. Mn, as a solid solution strengthening element, can improve the hardenability of steel, but excessive content of Mn will promote the growth of austenitic grains in the steel. Cr can improve the hardenability of steel, make the structure of the steel uniform, refine the grains, and greatly improve the corrosion resistance of the steel. Considering the two factors of cost and performance, a content of Cr is selected to be 9.5% to 13.5%. Ni can improve the strength and hardness of the sucker rod and make it have excellent mechanical properties. Mo can reduce the activity of hydrogen and hydrogen traps in steel, and improve the fatigue resistance of steel. The high content of C will increase the corrosion rate of the sucker rod, but the high corrosion resistance of the sucker rod can be guaranteed when the content of C is controlled below 0.07%. S will produce sulfur compounds when heated, and sulfides in steel will cause hot brittleness and reduce the toughness of steel, thereby making the steel to form cracks during forging. Besides, S tends to form pitting corrosion with chloride in corrosive liquids, so a content of S is controlled below 0.005%. Compared with Cr, rare earth niobium (Nb) and vanadium (V) are strong carbide forming elements. Nb and V preferentially form dispersed carbide particles and high-density dislocation tangles, which hinder the motion of dislocations, thus reducing the stress corrosion cracking sensitivity of materials.

Further, the raw materials for preparing the high-strength and corrosion-resistant sucker rod further include: by weight percent, V: ≤0.50% and Nb: ≤0.30%.

Further, the raw materials for preparing the high-strength and corrosion-resistant sucker rod include: by weight percent, Mn: 0.80% to 1.00%, Cr: 11.00% to 12.50%, Ni: 0.70% to 1.00%, Mo: 0.25% to 0.65%, Cu: 0.30% to 0.50%, V: ≤0.50%, Nb: ≤0.30%, C: ≤0.07%, Si: ≤0.50%, P: ≤0.08%, S: ≤0.005%, and the balance is Fe and unavoidable impurities.

Further, the raw materials for preparing the high-strength and corrosion-resistant sucker rod include: by weight percent, Mn: 0.90%, Cr: 12.00%, Ni: 0.85%, Mo: 0.35%, Cu: 0.40%, V: ≤0.32%, Nb: ≤0.23%, C: ≤0.07%, Si: ≤0.50%, P: ≤0.035%, S: ≤0.005%, and the balance is Fe and unavoidable impurities.

Further, the raw materials for preparing the high-strength and corrosion-resistant sucker rod include: by weight percent, Mn: 0.85%, Cr: 11.80%, Ni: 0.90%, Mo: 0.35%, Cu: 0.35%, V: ≤0.20%, Nb: ≤0.12%, C: 50.07%, Si: ≤0.20%, P: ≤0.065%, S: ≤0.005%, the balance is Fe and unavoidable impurities.

Another objective of the present invention is to provide a process for preparing the high-strength and corrosion-resistant sucker rod, which includes the following steps.

Step S10, weighing the raw materials of the high-strength and corrosion-resistant sucker rod according to the above-mentioned weight percentage.

Step S20, subjecting the raw materials for preparing the high-strength and corrosion-resistant sucker rod with the above weight percentage to a primary refining in an electric arc furnace, followed by a refining in an argon oxygen decarburization (AOD) furnace, a further refining outside a ladle furnace (LF), and a casting to obtain a steel ingot; in which the continuous-casting billet is subjected to a temperature-controlled rolling, and a finished rolling is carried out in a two-phase zone to control fine grains. The initial rolling temperature of the sucker rod is strictly controlled to avoid the impact of high temperature ferrite on the impact energy and fatigue strength of the materials. The finisher delivery temperature of the sucker rod is strictly controlled, and the temperature, deformation amount and deformation speed during the finishing rolling are precisely controlled to control the fine microstructure and properties of the rolled material, such as dislocation density and morphology.

Step S30, first heating the steel ingot obtained in step S20 to 550° C. to 580° C., keeping the temperature for 40 minutes to 80 minutes, heating to 850° C. to 920° C., keeping the temperature for 50 minutes to 90 minutes, then heating to a final temperature of 1,160° C. to 1,200° C., and keeping the temperature for 1 hour to 2.5 hours, and then taking out the heated steel ingot from the furnace for rolling to obtain a high-strength sucker rod bar.

Step S40: putting the high-strength sucker rod bar obtained in step S30 into a sodium chloride aqueous solution with a concentration of 8 wt %-12 wt % for a quenching treatment, and then performing a tempering treatment to obtain the high-strength and corrosion-resistant sucker rod.

Further, in step S30, the final temperature is 1,170° C.

Further, in step S40, process parameters of the quenching treatment are as follows: a quenching temperature is controlled to be 905° C.-918° C., and the quenching temperature is kept for 20 minutes to 40 minutes.

Further, in step S40, process parameters of the tempering treatment are as follows: a tempering temperature is controlled to be 550° C.-595° C., and the tempering temperature is kept for 42 minutes to 52 minutes.

The advantages of the present invention are as follows.

(1) In the present invention, according to the function of each element in steel and the specific requirements for steel types of a sucker rod, the mechanical properties and corrosion resistance of the sucker rod are improved by adjusting and optimizing the chemical composition, and the corrosion resistance of the sucker rod is improved by controlling the content of C, S, P and impurity elements As, Pb, Sn, Sb and B in the sucker rod.

(2) The actual grain size of the sucker rod prepared by the present invention is greater than or equal to grade 8, the mechanical properties are excellent, which meet the standard of grade HL specified in SY/T5029 *"Sucker Rods"*, and the corrosion rate is far less than the industry standard of 0.076 mm/a. The surface of the sucker rod after corrosion is smooth, without obvious corrosion product film, and the corrosion fatigue resistance is excellent.

(3) The product quality of the sucker rod prepared by the present invention is stable, the preparation process is simple and suitable for large-scale production.

BRIEF DESCRIPTION OF THE DRAWINGS

The drawings constituting a part of the present specification for further understanding of the present invention show the implementation modes of the present invention, and are used together with the specification to illustrate the preparation process of the present invention. In the drawings.

DETAILED DESCRIPTION OF THE EMBODIMENTS

Figure 1A:
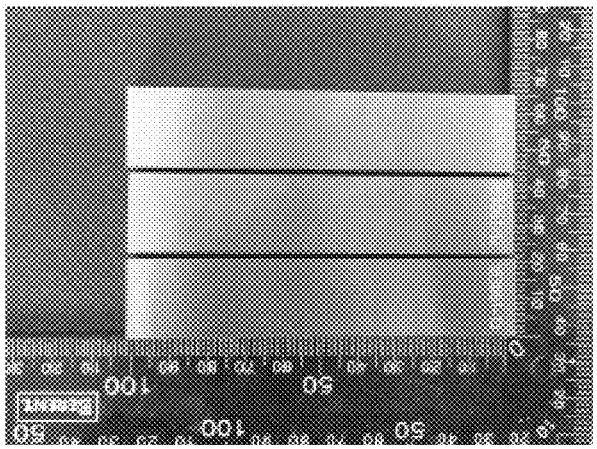
FIG. 1A is a diagram showing commercially available 1Cr13 steel before a hydrogen-induced cracking (HIC) experiment.
Figure 1B:
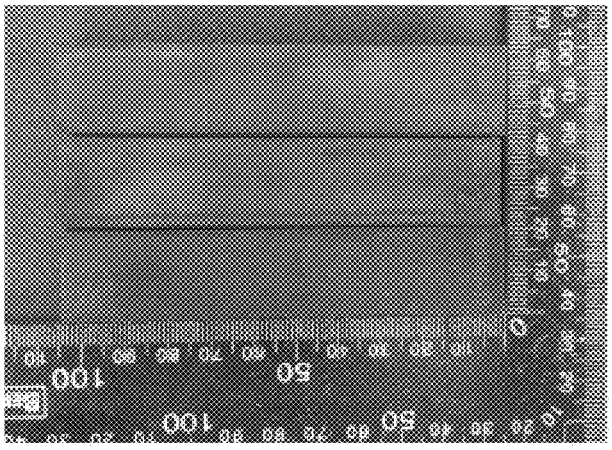
FIG. 1B is a diagram showing commercially available 1Cr13 steel after the HIC experiment.
Figure 2A:
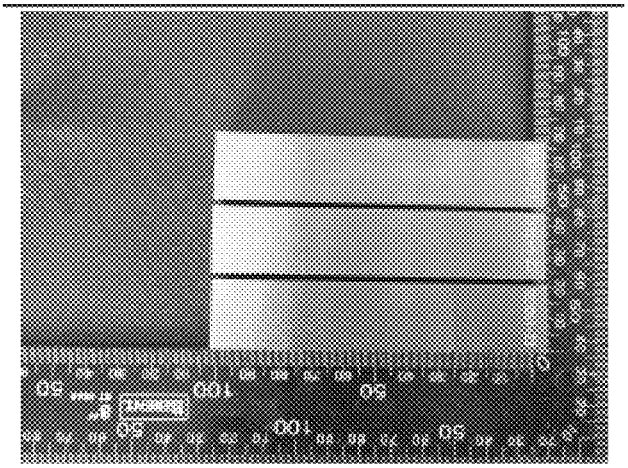
FIG. 2A is a diagram showing the sucker rod prepared in embodiment 6 of the present invention before the HIC experiment.
Figure 2B:
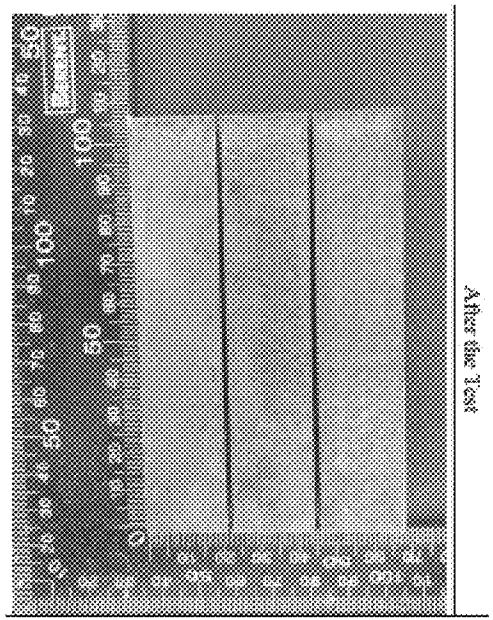
FIG. 2B is a diagram showing the sucker rod prepared in embodiment 6 of the present invention after the HIC experiment.

The embodiments of the present invention are described in detail below with reference to the drawings, but the present invention can be implemented in a variety of different ways claimed and covered by the claims.

Embodiment 1

High-Strength and Corrosion-Resistant Sucker Rod and Preparation Process Thereof.

The raw materials for preparing the high-strength and corrosion-resistant sucker rod include: by weight percent, Mn: 0.70%, Cr: 11.00%, Ni: 1.00%, Mo: 0.90%, Cu: 0.30%, V: 0.50%, Nb: 0.30%, C: 0.07%, Si: 0.30%, P: 0.08%, S: 0.005%, and the balance is Fe and unavoidable impurities.

The high-strength and corrosion-resistant sucker rod is prepared by the process as follows.

Step S10, the raw materials of the high-strength and corrosion-resistant sucker rod are weighed according to the above-mentioned weight percentage.

Step S20, the raw materials for preparing the high-strength and corrosion-resistant sucker rod with the above weight percentage is subjected to a primary refining in an electric arc furnace, followed by refining in an argon oxygen decarburization (AOD) furnace, and further refining outside a ladle furnace (LF), and then casting to obtain a steel ingot.

Step S30, the steel ingot obtained in step S20 is first heated to 550° C. and kept for 50 minutes, heated to 900° C. and kept for 90 minutes, then heated to a final temperature of 1,160° C. and kept for 1 hour, and then the heated steel ingot is taken out of the furnace for rolling to obtain a high-strength sucker rod bar.

Step S40: the high-strength sucker rod bar obtained in step S30 is put into a sodium chloride aqueous solution with a concentration of 9 wt % for a quenching treatment at 905° C. for 25 minutes, and then a tempering treatment is performed at 580° C. for 50 minutes to obtain the high-strength and corrosion-resistant sucker rod.

Embodiment 2

High-Strength and Corrosion-Resistant Sucker Rod and Preparation Process Thereof.

The raw materials for preparing the high-strength and corrosion-resistant sucker rod include: by weight percent, Mn: 0.80%, Cr: 12.50%, Ni: 0.65%, Mo: 0.35%, Cu: 0.56%, V: 0.40%, Nb: 0.18%, C: 0.06%, Si: 0.30%, P: 0.035%, S: 0.004%, and the balance is Fe and unavoidable impurities.

The high-strength and corrosion-resistant sucker rod is prepared by the process as follows.

Step S10, the raw materials of the high-strength and corrosion-resistant sucker rod are weighed according to the above-mentioned weight percentage.

Step S20, the raw materials for preparing the high-strength and corrosion-resistant sucker rod with the above weight percentage is subjected to a primary refining in an electric arc furnace, followed by refining in an AOD furnace, and further refining outside a LF furnace, and then casting to obtain a steel ingot.

Step S30, the steel ingot obtained in step S20 is first heated to 560° C. and kept for 40 minutes, heated to 920° C. and kept for 60 minutes, then heated to a final temperature of 1,170° C. and kept for 1.5 hours, and then the heated steel ingot is taken out of the furnace for rolling to obtain a high-strength sucker rod bar.

Step S40: the high-strength sucker rod bar obtained in step S30 is put into a sodium chloride aqueous solution with a concentration of 8 wt % for a quenching treatment at 910° C. for 40 minutes, and then a tempering treatment is performed at 590° C. for 52 minutes to obtain the high-strength and corrosion-resistant sucker rod.

Embodiment 3

High-Strength and Corrosion-Resistant Sucker Rod and Preparation Process Thereof.

The raw materials for preparing the high-strength and corrosion-resistant sucker rod include: by weight percent, Mn: 1.20%, Cr: 9.50%, Ni: 0.70%, Mo: 0.65%, Cu: 0.28%, V: 0.15%, Nb: 0.10%, C: 0.06%, Si: 0.40%, P: 0.01%, S: 0.005%, and the balance is Fe and unavoidable impurities.

The high-strength and corrosion-resistant sucker rod is prepared by the process as follows.

Step S10, the raw materials of the high-strength and corrosion-resistant sucker rod are weighed according to the above-mentioned weight percentage.

Step S20, the raw materials for preparing the high-strength and corrosion-resistant sucker rod with the above weight percentage is subjected to a primary refining in an electric arc furnace, followed by refining in an AOD furnace, and further refining outside a LF furnace, and then casting to obtain a steel ingot.

Step S30, the steel ingot obtained in step S20 is first heated to 580° C. and kept for 70 minutes, heated to 860° C. and kept for 50 minutes, then heated to a final temperature of 1,180° C. and kept for 2.5 hours, and then the heated steel ingot is taken out of the furnace for rolling to obtain a high-strength sucker rod bar.

Step S40: the high-strength sucker rod bar obtained in step S30 is put into a sodium chloride aqueous solution with a concentration of 11 wt % for a quenching treatment at 918° C. for 35 minutes, and then a tempering treatment is performed at 560° C. for 42 minutes to obtain the high-strength and corrosion-resistant sucker rod.

Embodiment 4

High-Strength and Corrosion-Resistant Sucker Rod and Preparation Process Thereof.

The raw materials for preparing the high-strength and corrosion-resistant sucker rod include: by weight percent, Mn: 1.00%, Cr: 13.50%, Ni: 1.10%, Mo: 0.10%, Cu: 0.50%, V: 0.12%, Nb: 0.08%, C: 0.07%, Si: 0.50%, P: 0.015%, S: 0.003%, and the balance is Fe and unavoidable impurities.

The high-strength and corrosion-resistant sucker rod is prepared by the process as follows.

Step S10, the raw materials of the high-strength and corrosion-resistant sucker rod are weighed according to the above-mentioned weight percentage.

Step S20, the raw materials for preparing the high-strength and corrosion-resistant sucker rod with the above weight percentage is subjected to a primary refining in an electric arc furnace, followed by refining in an AOD furnace, and further refining outside a LF furnace, and then casting to obtain a steel ingot.

Step S30, the steel ingot obtained in step S20 is first heated to 570° C. and kept for 80 minutes, heated to 850° C. and kept for 80 minutes, then heated to a final temperature of 1,200° C. and kept for 2.0 hours, and then the heated steel ingot is taken out of the furnace for a rolling to obtain a high-strength sucker rod bar.

Step S40: the high-strength sucker rod bar obtained in step S30 is put into a sodium chloride aqueous solution with a concentration of 12 wt % for a quenching treatment at 915° C. for 20 minutes, and then a tempering treatment is performed at 550° C. for 45 minutes to obtain the high-strength and corrosion-resistant sucker rod.

Embodiment 5

High-Strength and Corrosion-Resistant Sucker Rod and Preparation Process Thereof.

The raw materials for preparing the high-strength and corrosion-resistant sucker rod include: by weight percent, Mn: 0.85%, Cr: 11.80%, Ni: 0.90%, Mo: 0.35%, Cu: 0.35%, V: 0.20%, Nb: 0.12%, C: 0.07%, Si: 0.20%, P: 0.065%, S: 0.005%, and the balance is Fe and unavoidable impurities.

The high-strength and corrosion-resistant sucker rod is prepared by the process as follows.

Step S10, the raw materials of the high-strength and corrosion-resistant sucker rod are weighed according to the above-mentioned weight percentage.

Step S20, the raw materials for preparing the high-strength and corrosion-resistant sucker rod with the above weight percentage is subjected to a primary refining in an electric arc furnace, followed by refining in an AOD furnace, and further refining outside a LF furnace, and then casting to obtain a steel ingot.

Step S30, the steel ingot obtained in step S20 is first heated to 580° C. and kept for 20 minutes, heated to 900° C. and kept for 60 minutes, then heated to a final temperature of 1,180° C. and kept for 1.0 hour, and then the heated steel ingot is taken out of the furnace for rolling to obtain a high-strength sucker rod bar.

Step S40: the high-strength sucker rod bar obtained in step S30 is put into a sodium chloride aqueous solution with a concentration of 8 wt % for a quenching treatment at 915° C. for 30 minutes, and then a tempering treatment is performed at 565° C. for 50 minutes to obtain the high-strength and corrosion-resistant sucker rod.

Embodiment 6

High-Strength and Corrosion-Resistant Sucker Rod and Preparation Process Thereof.

The raw materials for preparing the high-strength and corrosion-resistant sucker rod include: by weight percent, Mn: 0.90%, Cr: 12.00%, Ni: 0.85%, Mo: 0.35%, Cu: 0.40%, V: 0.32%, Nb: 0.23%, C: 0.07%, Si: 0.50%, P: 0.035%, S: 0.004%, and the balance is Fe and unavoidable impurities.

The high-strength and corrosion-resistant sucker rod is prepared by the process as follows.

Step S10, the raw materials of the high-strength and corrosion-resistant sucker rod are weighed according to the above-mentioned weight percentage.

Step S20, the raw materials for preparing the high-strength and corrosion-resistant sucker rod with the above weight percentage is subjected to a primary refining in an electric arc furnace, followed by refining in an AOD furnace, and further refining outside a LF furnace, and then casting to obtain a steel ingot.

Step S30, the steel ingot obtained in step S20 is first heated to 570° C. and kept for 60 minutes, heated to 880° C. and kept for 70 minutes, then heated to a final temperature of 1,170° C. and kept for 2.0 hour, and then the heated steel ingot is taken out of the furnace for rolling to obtain a high-strength sucker rod bar.

Step S40: the high-strength sucker rod bar obtained in step S30 is put into a sodium chloride aqueous solution with a concentration of 10 wt % for a quenching treatment at 910° C. for 30 minutes, and then a tempering treatment is performed at 570° C. for 48 minutes to obtain the high-strength and corrosion-resistant sucker rod.

Comparative Example 1

High-Strength and Corrosion-Resistant Sucker Rod and Preparation Process Thereof.

The raw materials for preparing the high-strength and corrosion-resistant sucker rod include: by weight percent, Mn: 0.80%, Cr: 9.00%, Ni: 0.60%, Mo: 0.35%, Cu: 0.45%, V: 0.12%, Nb: 0.08%, C: 0.06%, Si: 0.30%, P: 0.01%, S: 0.004%, and the balance is Fe and unavoidable impurities.

The high-strength and corrosion-resistant sucker rod is prepared by the process as follows.

Step S10, the raw materials of the high-strength and corrosion-resistant sucker rod are weighed according to the above-mentioned weight percentage.

Step S20, the raw materials for preparing the high-strength and corrosion-resistant sucker rod with the above weight percentage is subjected to a primary refining in an electric arc furnace, followed by refining in an AOD furnace, and further refining outside a LF furnace, and then casting to obtain a steel ingot.

Step S30, the steel ingot obtained in step S20 is first heated to 570° C. and kept for 60 minutes, heated to 880° C. and kept for 70 minutes, then heated to a final temperature of 1,180° C. and kept for 2.0 hour, and then the heated steel ingot is taken out of the furnace for rolling to obtain a high-strength sucker rod bar.

Step S40: the high-strength sucker rod bar obtained in step S30 is put into a sodium chloride aqueous solution with a concentration of 10 wt % for a quenching treatment at 908° C. for 30 minutes, and then a tempering treatment is performed at 570° C. for 48 minutes to obtain the high-strength and corrosion-resistant sucker rod.

Comparative Example 2

High-Strength and Corrosion-Resistant Sucker Rod and Preparation Process Thereof.

The raw materials for preparing the high-strength and corrosion-resistant sucker rod include: by weight percent, Mn: 0.80%, Cr: 9.00%, Ni: 0.60%, Mo: 0.35%, Cu: 0.45%, V: 0.22%, Nb: 0.18%, C: 0.06%, Si: 0.30%, P: 0.01%, S: 0.004%, and the balance is Fe and unavoidable impurities.

The high-strength and corrosion-resistant sucker rod is prepared by the process as follows.

Step S10, the raw materials of the high-strength and corrosion-resistant sucker rod are weighed according to the above-mentioned weight percentage.

Step S20, the raw materials for preparing the high-strength and corrosion-resistant sucker rod with the above weight percentage is subjected to a primary refining in an electric arc furnace, followed by refining in an AOD furnace, and further refining outside a LF furnace, and then casting to obtain a steel ingot.

Step S30, the steel ingot obtained in step S20 is first heated to 570° C. and kept for 60 minutes, heated to 880° C. and kept for 70 minutes, then heated to a final temperature of 1,160° C. and kept for 2.0 hour, and then the heated steel ingot is taken out of the furnace for rolling to obtain a high-strength sucker rod bar.

Step S40: the high-strength sucker rod bar obtained in step S30 is put into a sodium chloride aqueous solution with a concentration of 10 wt % for a quenching treatment at 918° C. for 30 minutes, and then a tempering treatment is performed at 570° C. for 48 minutes to obtain the high-strength and corrosion-resistant sucker rod.

Experimental Example

To further illustrate the technological advancement of the present invention, experiments are presented hereinafter to further illustrate.

1. Mechanical Property Testing

The high-strength and corrosion-resistant sucker rods prepared in embodiments 5 and 6 and comparative examples 1 and 2 of the present invention are selected for mechanical performance testing. Among them, the high-strength corrosion-resistant rods in comparative examples 1 and 2 are obtained by rolling with a lower Cr content, and the data are shown in Table 1.

TABLE 1

| Test material | Test item | Unit | Test results | | | Test method |
|---|---|---|---|---|---|---|
| Embodiment 5 | $R_{p0.2}$ | MPa | 947 | 944 | 947 | GB/T228.1-2010 |
| | Rm | MPa | 1256 | 1263 | 1266 | A124 |
| | A | % | 20.0 | 19.5 | 17.0 | |
| | Z | % | 72 | 72 | 71 | |
| | $KU_2$ | J | 234, 257, 230 | | | |
| | Grain size | Grade | 8.0 | | | GB/T6394-2002A method |
| | Microstructure | / | Tempered martensite | | | GB/T13320-2007 |
| | Rockwell hardness | HRC | 41.1 | 41.2 | 40.6 | GB/T230.1-2009 |
| Embodiment 6 | $R_{p0.2}$ | MPa | 961 | 987 | 955 | GB/T228.1-2010 |
| | Rm | MPa | 1260 | 1221 | 1230 | A124 |
| | A | % | 18.0 | 17.0 | 16.5 | |
| | Z | % | 73 | 72 | 73 | |
| | $KU_2$ | J | 237, 232, 249 | | | |
| | Grain size | Grade | 8.0 | | | GB/T6394-2002A method |
| | Microstructure | / | Tempered martensite | | | GB/T13320-2007 |
| | Rockwell hardness | HRC | 39.1 | 38.3 | 38.2 | GB/T230.1-2009 |

TABLE 1-continued

| Test material | Test item | Unit | Test results | | | Test method |
|---|---|---|---|---|---|---|
| Comparative Example 1 | $R_{p0.2}$ | MPa | 872 | 832 | 828 | GB/T228.1-2010 |
| | Rm | MPa | 1,057 | 1,019 | 1,007 | A124 |
| | A | % | 15.5 | 16.5 | 15.0 | |
| | Z | % | 46.0 | 47.0 | 52.0 | |
| | $KU_2$ | J | 40, 34, 33 | | | |
| | Grain size | Grade | 6.5 | | | GB/T6394-2002A method |
| | Microstructure | / | Tempered torsite | | | GB/T13320-2007 |
| | Rockwell hardness | HRC | 33.3 | 35.4 | 33.8 | GB/T230.1-2009 |
| Comparative Example 2 | $R_{p0.2}$ | MPa | / | 1,149 | 1,130 | GB/T228.1-2010 |
| | Rm | MPa | 1,180 | 1,187 | 1,175 | A124 |
| | A | % | 14.5 | 15.5 | 15.5 | |
| | Z | % | 47.0 | 54.0 | 55.0 | |
| | $KU_2$ | J | 72, 75, 72 | | | |
| | Grain size | Grade | 6.5 | | | GB/T6394-2002A method |
| | Microstructure | / | Tempered torsite | | | GB/T13320-2007 |
| | Rockwell hardness | HRC | 35.9 | 36.3 | 35.2 | GB/T230.1-2009 |

2. Corrosion Resistance Testing (1) Sulfuric Acid Corrosion Resistance Testing

Experimental samples: high-strength and corrosion-resistant sucker rods (sample size: 50×10×3 mm) prepared in embodiments 5 and 6 of the present invention, as well as commercially available 4330M steel (4330 modified steel) and 4138 steel, and five samples of each type are selected.

Corrosion solution: $H_2SO_4$ mixed solution (n % $H_2SO_4$+5% NaCl+0.5% $CH_3COOH$+$H_2O$) 500 mL.

Experimental conditions: placed at normal pressure and temperature (NPT) for 168 h, and the experimental results are shown in Table 2.

TABLE 2

Test results of corrosion resistance of the high-strength and corrosion-resistant sucker rods prepared in embodiments 5 and 6 of the present invention, and commercially available 4330M steel and 4138 steel to sulfuric acid mixed solution

| Material | $H_2SO_4$ mixed solution | Weight before corrosion (g) | Weight after corrosion (g) | Weight loss | Weight loss rate (%) | Corrosion rate (mm/a) |
|---|---|---|---|---|---|---|
| Embodiment 5 | 1.0 + 5.0 + 0.5 | 12242.8 | 11018.3 | 1224.5 | 10.00 | 10.096 |
| | 0.5 + 5.0 + 0.5 | 9574.8 | 8231.8 | 1343.0 | 14.03 | 13.036 |
| | 0.1 + 5.0 + 0.5 | 11071.2 | 10604.1 | 467.1 | 4.22 | 4.116 |
| | 0.05 + 5.0 + 0.5 | 9072.5 | 8992.4 | 80.1 | 0.88 | 0.810 |
| | 0.01 + 5.0 + 0.5 | 9591.1 | 9550.1 | 41.0 | 0.43 | 0.398 |
| Embodiment 6 | 1.0 + 5.0 + 0.5 | 12041.2 | 10793.7 | 1247.5 | 10.36 | 10.392 |
| | 0.5 + 5.0 + 0.5 | 10766.7 | 9200.2 | 1566.5 | 14.55 | 14.078 |
| | 0.1 + 5.0 + 0.5 | 9393.3 | 8941.7 | 451.6 | 4.81 | 4.441 |
| | 0.05 + 5.0 + 0.5 | 9337.5 | 9242.8 | 94.7 | 1.01 | 0.935 |
| | 0.01 + 5.0 + 0.5 | 9428.7 | 9357.0 | 71.7 | 0.76 | 0.704 |
| 4138 steel | 1.0 + 5.0 + 0.5 | 12239.9 | 8600.3 | 3639.6 | 29.74 | 30.058 |
| | 0.5 + 5.0 + 0.5 | 8654.2 | 5881.1 | 2773.1 | 32.04 | 28.861 |
| | 0.1 + 5.0 + 0.5 | 11258.5 | 9899.7 | 1358.8 | 12.07 | 11.866 |
| | 0.5 + 5.0 + 0.5 | 10481.9 | 9470.9 | 741.0 | 7.07 | 6.791 |
| | 0.01 + 05.0 + 0.5 | 9646.5 | 8963.0 | 683.5 | 7.09 | 6.619 |
| 4330M steel | 1.0 + 5.0 + 0.5 | 12017.9 | 9143.3 | 2874.6 | 23.91 | 23.850 |
| | 0.5 + 5.0 + 0.5 | 9372.8 | 9372.8 | 2682.5 | 28.62 | 26.468 |
| | 0.1 + 5.0 + 0.5 | 10388.4 | 9071.1 | 1317.3 | 12.68 | 12.139 |
| | 0.05 + 5.0 + 0.5 | 9801.5 | 8748.6 | 1052.9 | 10.74 | 10.083 |
| | 0.01 + 5.0 + 300.5 | 9904.4 | 9034.4 | 870.0 | 8.78 | 8.270 |

(2) Resistance Testing to Hydrogen-Induced Cracking (HIC)

Figure 3:
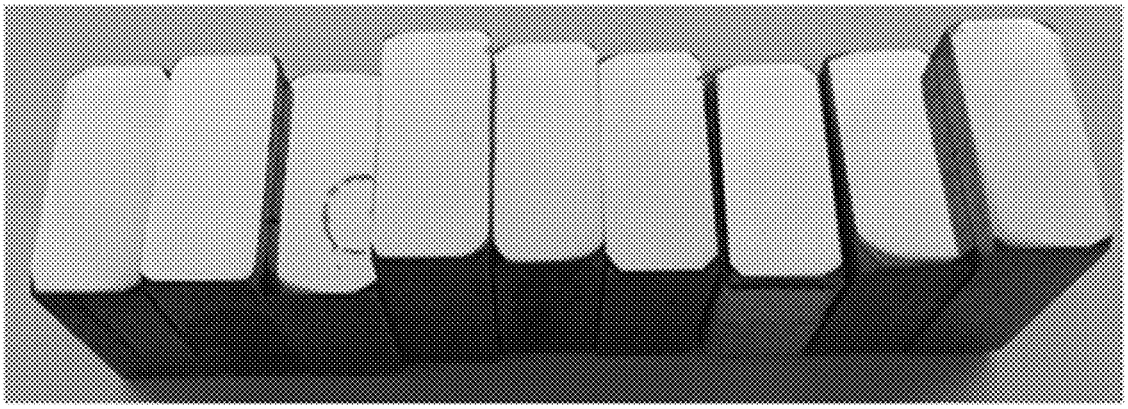
FIG. 3 is a diagram showing a test surface of the commercially available 1Cr13 steel in the HIC experiment.
Figure 4:
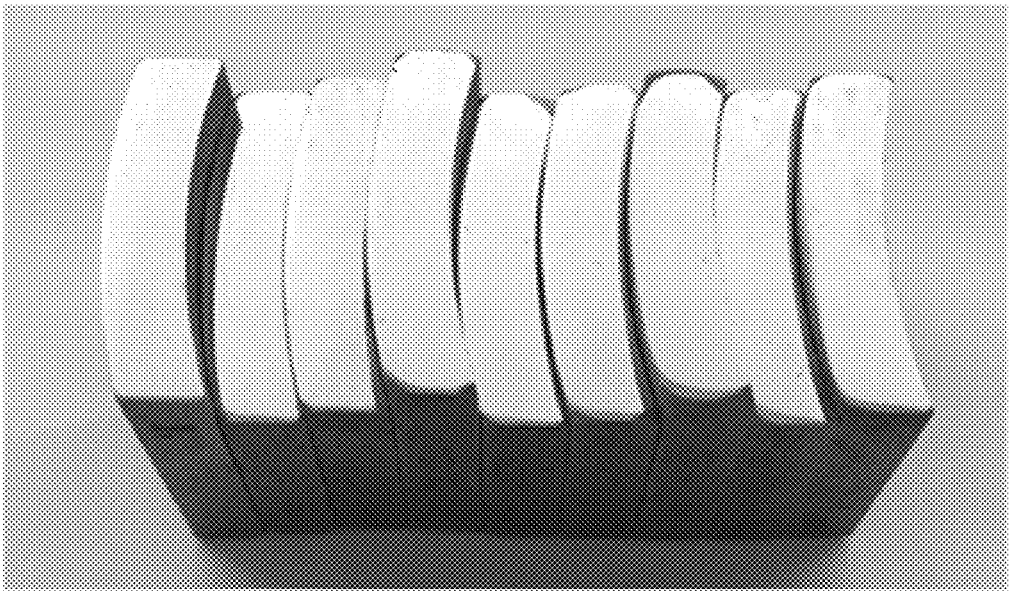
FIG. 4 is a diagram showing a test surface of the sucker rod prepared in embodiment 6 of the present invention in the HIC experiment.
Figure 5A:
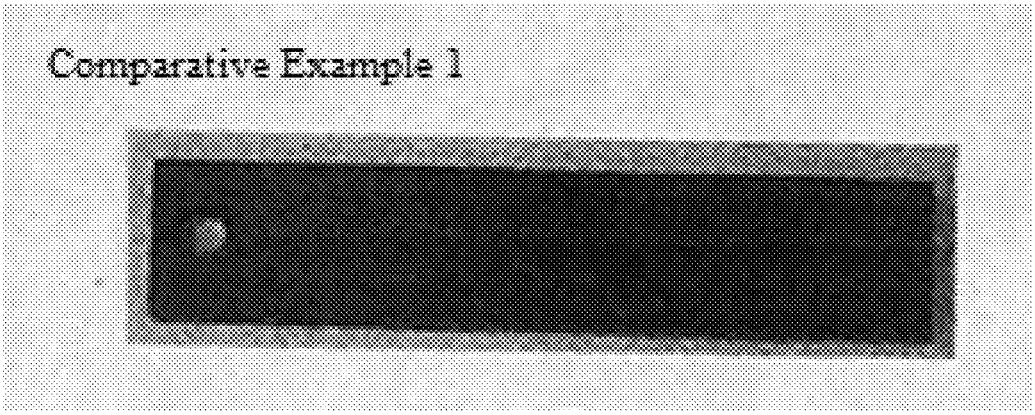
FIG. 5A is a diagram showing an appearance of a corrosion inhibitor for an oilfield produced water treatment before a property testing to comparative example 1.
Figure 5B:
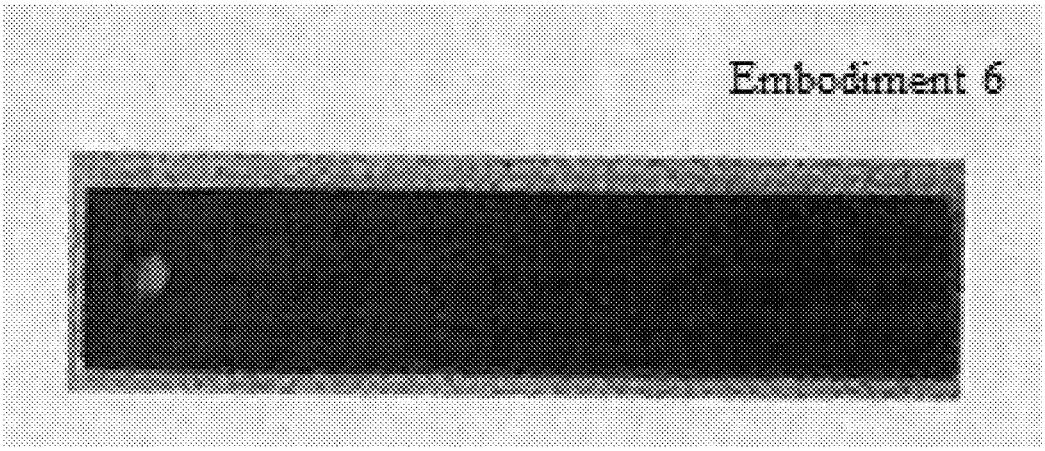
FIG. 5B is a diagram showing an appearance of the corrosion inhibitor for the oilfield produced water treatment before the property testing to embodiment 6.
Figure 6A:
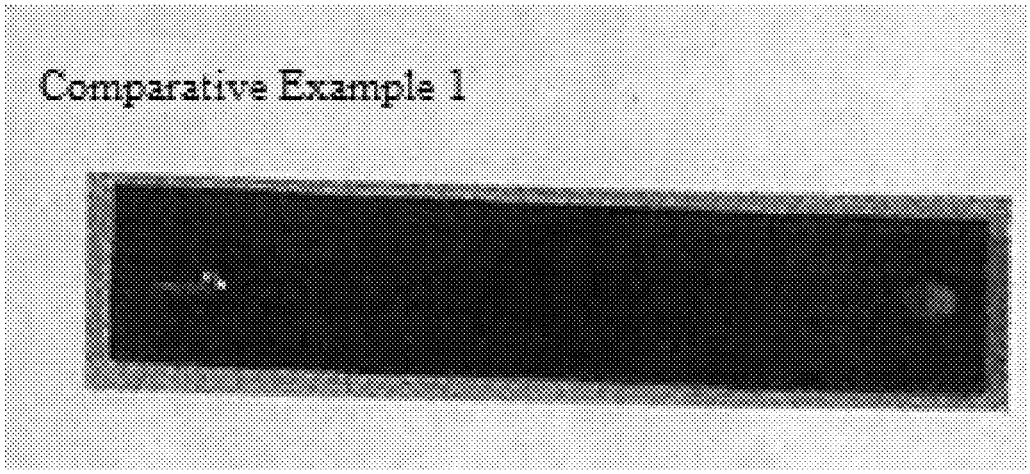
FIG. 6A is a diagram showing an appearance of the corrosion inhibitor for the oilfield produced water treatment after the property testing to comparative example 1.
Figure 6B:
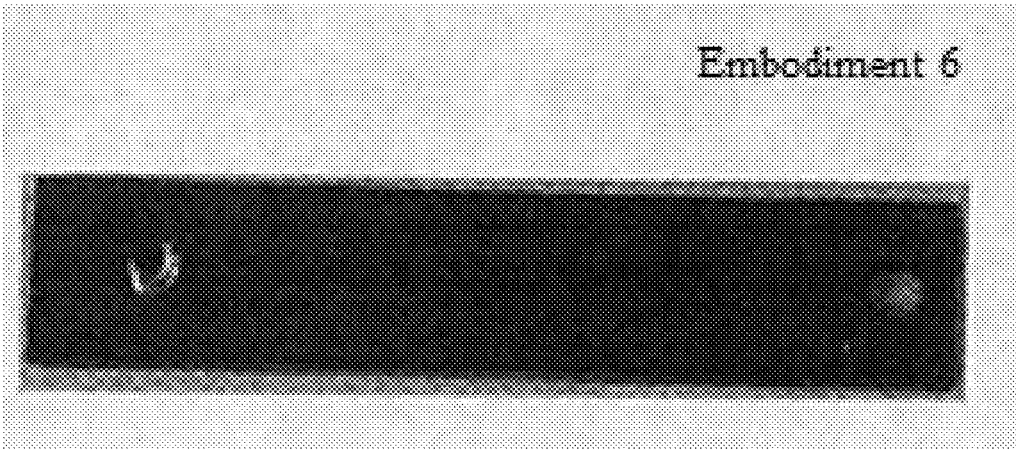
FIG. 6B is a diagram showing an appearance of the corrosion inhibitor for the oilfield produced water treatment after the property testing to embodiment 6.

According to the NACETM0284-2016 *"Evaluation of Pipelines and Pressure Vessel Steels for Resistance to HIC"*, the high-strength and corrosion-resistant sucker rod prepared in embodiment 6 of the present invention is subjected to the resistance testing to HIC, the commercially available 1Cr13 steel is used as a test sample of the comparative example 3, and three samples are selected for each type. The test information is shown in Table 3, the test results are shown in Tables 4 and 5, the diagrams of the samples before and after the experiment are shown in FIGS. 1A-B and FIGS. 2A-B, and the diagrams of the test surfaces are shown in FIG. 3 and FIG. 4.

TABLE 3

Test information of resistance testing to HIC of the high-strength and corrosion-resistant sucker rod prepared in embodiment 6 of the present invention and commercially available 1Cr13 steel

| Experiment temperature | Experiment time | Experiment solution | pH: Initial solution | pH: Saturated $H_2S$ solution | pH: Solution at the end of the experiment | $H_2S$ content in the saturated $H_2S$ solution | Debinding method |
|---|---|---|---|---|---|---|---|
| 25 ± 3° C. | 96 h | A solution | 2.70 | 2.83 | 3.77 | 2,680 mg/L | Acetone |

Note:
1. Solution A is a distilled water solution with mass fraction of 5% sodium chloride and 0.5% glacial acetic acid.
2. The experiment process include the following steps:
(1) preparing samples;
(2) putting each of the samples into a test container, respectively;
(3) preparing solution;
(4) measuring the pH of the initial solution;
(5) deoxidizing with nitrogen gas at a rate of 100 mL/min for two hours;
(6) feeding $H_2S$ at a rate of 100 mL/min for at least one hour until the solution is saturated;
(7) measuring the pH value and $H_2S$ content of the saturated $H_2S$ solution;
(8) maintaining the positive $H_2S$ pressure until the end of the experiment;
(9) measuring the pH value of the solution at the end of the experiment; and
(10) verifying the experimental results.

TABLE 4

Test results 1 of resistance testing to HIC of the high-strength and corrosion-resistant sucker rod prepared in embodiment 6 of the present invention and commercially available 1Cr13 steel

| Test material | Test surface | Crack length ratio (CLR, %): Measured value | Crack length ratio (CLR, %): Average value of each sample | Crack thickness ratio (CTR, %): Measured value | Crack thickness ratio (CTR, %): Average value of each sample | Crack sensitivity ratio (CSR, %): Measured value | Crack sensitivity ratio (CSR, %): Average value of each sample |
|---|---|---|---|---|---|---|---|
| Embodiment 6 | 001 | 0 | 0 | 0 | 0 | 0 | 0 |
| | 002 | 0 | | 0 | | 0 | |
| | 003 | 0 | | 0 | | 0 | |
| Comparative Example 3 | 001 | 8.307% | 6.796% | 5.629% | 7.251% | 0.05984% | 0.07952% |
| | 002 | 12.081% | | 16.125% | | 0.17872% | |
| | 003 | 0 | | 0 | | 0 | |

Under this test conditions, the HIC resistance of the sample of comparative example 3 cannot simultaneously meet the performance requirements of CLR≤15%, CSR≤2%/and CTR≤5%, and the CTR value is higher than the required value.

TABLE 5

Test results 2 of resistance testing to HIC of the high-strength and corrosion-resistant sucker rod prepared in embodiment 6 of the present invention and commercially available 1Cr13 steel

| Material | Weight before test (g) | Weight after test (g) | Corrosion rate (mm/a) | Weight after pickling (g) | Corrosion rate (mm/a) |
|---|---|---|---|---|---|
| Comparative Example 3-1 | 129.5170 | 129.4310 | 0.275 | / | / |
| Comparative Example 3-2 | 125.7703 | 125.6880 | 0.263 | 125.3737 | 0.281 |
| Comparative Example 3-3 | 126.1680 | 126.0811 | 0.277 | 126.0744 | 0.285 |
| Embodiment 6-1 | 203.9933 | 203.9205 | 0.122 | / | / |

TABLE 5-continued

Test results 2 of resistance testing to HIC of the high-strength and corrosion-resistant sucker rod prepared in embodiment 6 of the present invention and commercially available 1Cr13 steel

| Material | Weight before test (g) | Weight after test (g) | Corrosion rate (mm/a) | Weight after pickling (g) | Corrosion rate (mm/a) |
|---|---|---|---|---|---|
| Embodiment 6-2 | 204.0848 | 204.0284 | 0.090 | 204.0265 | 0.097 |
| Embodiment 6-3 | 203.9710 | 203.9118 | 0.101 | 203.9103 | 0.101 |

(3) Property Testing of Corrosion Inhibitor for Oilfield Produced Water Treatment According to SY/T5273-2014 *"Technical Specifications and Evaluating Methods of Corrosion-inhibitors for Oilfield Produced Water"*, the high-strength and corrosion-resistant sucker rods (with a sample size of 50×10×3 mm) prepared in embodiments 5 and 6 of the present invention are is subjected to the property testing.

Experimental process: a coupon experiment is carried out in a Wang 26-1 corrosive medium. The specific corrosion conditions are: the mineralization of water is 30,665 ppm, hydrogen sulfide is 200 ppm, carbon dioxide is 200 ppm, the temperature is 60° C., and the time is 7 days.

Test results: after the coupon experiment, the results are shown in Table 6, and the appearance views before and after the experiment are shown in FIGS. 5A-B and FIGS. 6A-B.

TABLE 6

Corrosion resistance test results of high-strength and corrosion-resistant sucker rods prepared in embodiments 5 and 6 of the present invention

| Material | Temperature/ ° C. | Corrosion rate/% | Mass before corrosion/g | Mass after film removal/g | Total mass loss after film removal/g | Annual corrosion rate mm/a |
|---|---|---|---|---|---|---|
| Embodiment 5 | 60 | 0.0065995 | 10.6068 | 10.6061 | 0.0007 | 0.003399263 |
| Embodiment 6 | 60 | 0.0056397 | 10.6388 | 10.6382 | 0.0006 | 0.002913654 |

Test conclusion: the high-strength and corrosion-resistant sucker rod of the present invention has a smooth surface without obvious corrosion product film after corrosion, and the corrosion rate is far less than the SY/T5329-2012 standard of 0.076 mm/a, which belongs to a light corrosion of <0.001 mm/a according to the standard of NACERP-0775-91 on the average corrosion level.

(4) Metal Stress Corrosion Test (Cracking)

Under the conditions of simulated operating conditions of water $P_{H_2S}$=0.25 MPa, $P_{CO_2}$=3.63 MPa and test temperature of 152° C., stress corrosion cracking (SCC) test is carried out on the high-strength and corrosion-resistant sucker rods prepared in embodiments 5 and 6 of the present invention. Three samples are selected for each type, and the test results are shown in Table 7.

TABLE 7

SCC test results of high-strength and corrosion-resistant sucker rods prepared in embodiments 5 and 6 of the present invention

| | Test time (h) | Test results |
|---|---|---|
| Embodiment 5-1 | 24 × 30 | 0.0135 mm/a |
| Embodiment 5-2 | | 0.0045 mm/a |
| Embodiment 5-3 | | 0.0192 mm/a |
| Embodiment 6-1 | 24 × 60 | 0.0260 mm/a |
| Embodiment 6-2 | | 0.0136 mm/a |
| Embodiment 6-3 | | 0.0109 mm/a |

The results show that the corrosion of each sample is uniform corrosion without local corrosion such as pitting corrosion. The corrosion rate is relatively low, and lower than the corrosion rate at 150° C. in $CO_2$ environment, which belongs to the slight corrosion in the NACE standard. The corrosion products on the sample surface are densely distributed, and the main components in the corrosion products of embodiments 5 and 6 are FeS, $Fe_7S_8$ and $FeS_2$.

The foregoing descriptions are merely preferred embodiments of the present invention, which are not used to limit the present invention. For those skilled in the art, the present invention may have various modifications and variations. Any modifications, equivalent substitutions, improvements within the spirit and principle of the present invention shall fall within the protective scope of the present invention.

What is claimed is:

1. A preparation process of a sucker rod, comprising the following steps:

step S10; weighing raw materials for preparing the sucker rod according to a weight percentage, wherein the raw materials for preparing the sucker rod comprise: by weight percent, Mn: 0.80% to 1.00%, Cr: 11.00% to 12.50%, Ni: 0.70% to 1.00%, Mo: 0.25% to 0.65%, Cu: 0.30% to 0.50%, V: ≤0.50%, Nb: ≤0.30%, C: ≤0.07%, Si: ≤0.50%, P: ≤0.02%, S: ≤0.005%, and a balance is Fe and unavoidable impurities;

A step S20: subjecting the raw materials for preparing the sucker rod with the weight percentage to a primary refining in an electric arc furnace to obtain a first refined product, followed by a second refining of the first refined product in an argon oxygen decarburization furnace to obtain a second refined product, a third refining on the second refined product outside a ladle furnace to obtain a third refined product, and casting the third refined product to obtain a steel ingot;

step S30: first heating the steel ingot obtained in step S20 to 550° C. to 580° C., keeping the steel ingot at 550° C. to 580° C. for 40 minutes to 80 minutes, heating the steel ingot to 850° C. to 920° C., keeping the steel ingot at 850° C. to 920° C. for 50 minutes to 90 minutes, then heating the steel ingot to a final temperature of 1,160° C. to 1,200° C., and keeping the final temperature of the steel ingot for 1 hour to 2.5 hours to obtain a heated steel ingot, and then taking the heated steel ingot out from a heating furnace for a rolling to obtain a sucker rod bar, and step S40: putting the sucker rod bar obtained in step S30 into a sodium chloride aqueous solution with a concentration of 8 wt %-12 wt % for a quenching treatment to obtain a treated sucker rod bar, and then performing a tempering treatment on the treated sucker rod bar to obtain the sucker rod.

2. The preparation process according to claim 1, wherein in step S30, the final temperature is 1,170° C.

3. The preparation process according to claim 1, wherein in step S40, a quenching temperature of the quenching treatment is controlled to be 905° C.-918° C., and the quenching temperature is kept for 20 minutes to 40 minutes.

4. The preparation process according to claim 1, wherein in step S40, a tempering temperature of the tempering treatment is controlled to be 550° C.-595° C., and the tempering temperature is kept for 42 minutes to 52 minutes.

5. The preparation process according to claim 1, wherein the raw materials for preparing the sucker rod comprise: by weight percent, Mn: 0.90%, Cr: 12.00%, Ni: 0.85%, Mo: 0.35%, Cu: 0.40%, V: ≤0.32%, Nb: ≤0.25%, C: ≤0.07%, Si: ≤0.50%, P: ≤0.002%, S: ≤0.005%, and the balance is Fe and unavoidable impurities.

6. The preparation process according to claim 1, wherein the raw materials for preparing the sucker rod comprise: by weight percent, Mn: 0.85%, Cr: 11.80%, Ni: 0.90%, Mo: 0.35%, Cu: 0.35%, V: ≤0.20%, Nb: ≤0.12%, C: ≤0.07%, Si: ≤0.20%, P: ≤0.02%, S: ≤0.005%, and the balance is Fe and unavoidable impurities.

* * * * *